United States Patent [19]

Fisher

[11] Patent Number: 4,470,275

[45] Date of Patent: Sep. 11, 1984

[54] SECURITY ENCLOSURES

[75] Inventor: Jeffrey O. Fisher, Bridgnorth, England

[73] Assignee: Chubb & Son's Lock and Safe Company Limited, London, England

[21] Appl. No.: 230,479

[22] Filed: Feb. 2, 1981

[51] Int. Cl.[3] ..... E05B 63/00

[52] U.S. Cl. ..... 70/1.5; 70/1.7; 70/333 R; 70/417

[58] Field of Search ..... 70/1.5, 1.7, 417, 333, 70/416

[56] References Cited

U.S. PATENT DOCUMENTS

| | | | |
|---|---|---|---|
| 1,384,509 | 7/1921 | Blecksmith | 70/1.5 |
| 1,448,525 | 3/1923 | Dillon | 70/1.5 |
| 1,550,953 | 8/1925 | Dillon | 70/1.5 |
| 3,083,563 | 4/1963 | Greenwald | 70/417 |

FOREIGN PATENT DOCUMENTS

| | | | |
|---|---|---|---|
| 32006 | 12/1909 | Sweden | 70/1.5 |

*Primary Examiner*—Robert L. Wolfe

*Attorney, Agent, or Firm*—Pollock, Vande Sande & Priddy

[57] ABSTRACT

The door of a security enclosure has boltwork and a primary lock for locking the boltwork in its thrown condition. A drill-resistant disc is rotatably mounted between the lock and the exterior of the door, and the restraining wire of a relocker passes over the circumference of the disc. If a drilling attack is made on the lock the disc will be encountered and will be rotated by the drill tip to frustrate penetration of the disc by the drill. Furthermore, if the drill is aimed at the circumferential portion of the disc which guides the relocker wire any success in penetrating the disc will sever or dislodge the wire to allow the relocker to move under the action of a spring into a position in which it provides an additional locking action in the boltwork.

2 Claims, 1 Drawing Figure

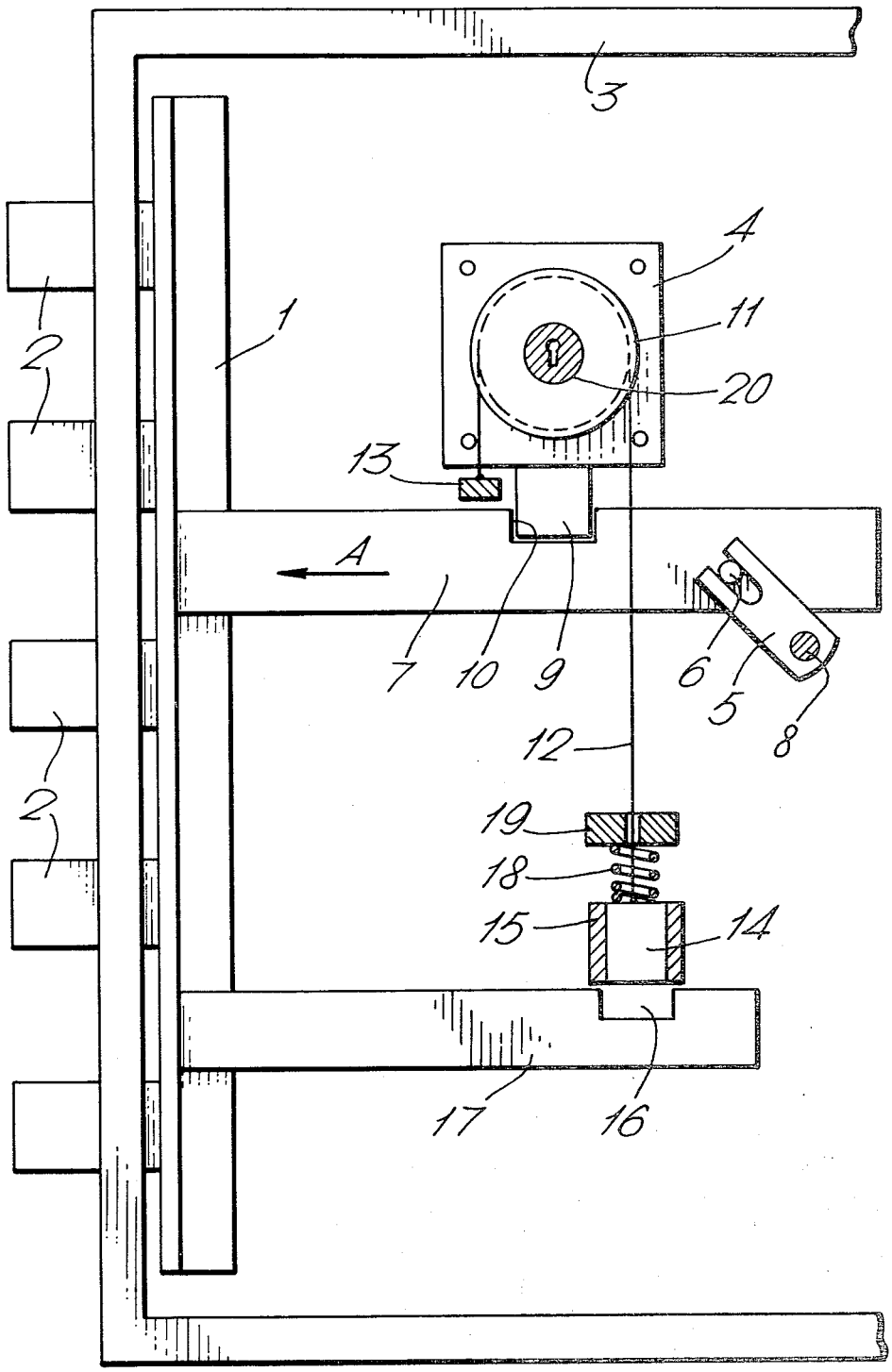
3
4
11
20
1
2
13
A
7
10
9
6
5
8
12
2
19
18
15
14
17
16

SECURITY ENCLOSURES

The present invention relates to safes, vaults, strongrooms and the like security enclosures, and more particularly to a locking mechanism for the door of such an enclosure.

One method of attack commonly adopted by miscreants when attempting to make a forcible entry to a safe or the like is to drill through the door of the enclosure to remove or render ineffective certain vital parts of the lock or locks which are provided to keep the main boltwork in its thrown condition. In order to increase the time required for such an attack to be successful it is known to reinforce the doors of such enclosures in the vicinity of their locks with plates of hardened steel or the like drill-resistant material which must be penetrated before access to the corresponding lock can be gained. Another known measure aimed at thwarting a forcible attack is the so-called relocker. This comprises a secondary locking member which is capable of providing an additional automatic locking action on the boltwork independently of the state of the primary lock(s), in the event of a forcible attack being detected, such as by the release of a cord which normally holds the secondary locking member away from its locking position (i.e. in a 'dead' relocker) or which connects the secondary locking member to a primary lock bolt (i.e. in a 'live' relocker which normally is engaged and released together with the primary lock).

It is an aim of the invention to improve the security of safes or the like enclosures by providing a locking mechanism in which drill-resistant and relocking means are integrated together in an optimum manner.

Accordingly, in one aspect the invention resides in a locking mechanism for the door of a security enclosure, comprising: boltwork for securing the door closed when thrown; a primary lock for selectively locking the boltwork in its thrown condition; a drill-resistant disc rotatably mounted in a position between the primary lock and the exterior of the door; a secondary locking member capable of locking the boltwork in its thrown condition and being biased towards a locking position; and a cord, wire, chain or other flexible tension member passing over at least part of the circumference of the drill-resistant disc and arranged normally to maintain the secondary locking member away from its locking position against such bias, or to withdraw the secondary locking member from its locking position against such bias when the primary lock is released, relieving the tension in the flexible tension member permitting the secondary locking member to move into, or remain in, its locking position under such bias.

The invention also provides, per se, a safe, vault, strongroom or the like security enclosure having a door with a locking mechanism in accordance with the above.

If an attempt is made to drill through the door of such an enclosure to reach the primary lock the drill-resistant disc will be encountered and will hamper the operation, the more so because the disc is mounted for rotation. When the drill tip encounters the disc the latter will tend to rotate, thereby dissipating the energy of the drill and preventing a concerted drilling action at any one point on the surface of the disc.

It is particularly advantageous if the disc is arranged so that its circumferential region lies in front of those portions of the primary lock which are most susceptible to attack. In this way, if an attempt is made to drill into these portions the drill tip will encounter the disc in the region where the frustrating effects of its rotation are the greatest. More than this, however, because the flexible tension member (of the relocker) also passes over this region of the disc any eventual success in drilling through the disc will also result in the severing or dislodgement of that member so that the secondary locking member will engage, or remain engaged, therefore defeating the effects of any success in releasing the primary lock.

An illustrative embodiment of the invention will now be more particularly described, by way of example, with reference to the accompanying schematic elevation of the internal components of a safe door embodying the invention, showing the boltwork thrown and locked.

Referring to the drawing, there is shown at 1 a strap carrying bolts 2 which are provided along the edge of a safe door 3 for engagement with the body of the safe when thrown. The bolts are thrown in the direction of the arrow A, and can then be locked in position by operation of a primary lock 4. Suitable mechanisms by which the bolts can be thrown and locked will be known to those skilled in the art, but for the purpose of illustration they are shown as a crank 5 which drives a pin 6 on a cross-arm 7 attached to the bolt strap when the spindle 8 of the crank is turned by an externally-accessible handle (not shown), and a bolt 9 of the lock which engages in a notch 10 of the arm 7 to block subsequent withdrawal of the bolt strap.

Rotatably mounted between the lock 4 and the front face of the door is a disc 11 of hardened steel or other drill-resistant material. Conveniently the disc may be borne by the key guide 20, e.g. where the lock 4 is a lever or other key-operated lock, and the diameter of the disc is so chosen having regard to the position of its rotational axis that its circumferential region lies in front of those portions of the lock which are most susceptible to attack. The disc 11 also has a circumferential groove in which is guided a wire 12. One end of the wire is secured to a fixed anchorage 13 and the other end to a plunger 14 which forms the secondary locking member of the mechanism. The plunger 14 is borne in a housing 15 and is biased downwardly towards a notch 16 in a second cross-arm 17 attached to the bolt strap 1, by means of a spring 18 compressed between the plunger and a fixed abutment 19. The effective length of the wire 12 is such that so long as it remains intact and passes over the disc 11 it holds the plunger 14 away from the crossarm 17 against the bias of the spring 18.

Now let it be supposed that an attack is made on the safe, with the intention of drilling through the door and into a vital portion of the lock 4. If this is attempted the drill bit will encounter the disc 11 which, as indicated, is of a material resistant to drilling and hence will substantially delay the penetration of the drill to the lock. The drill will be further frustrated by the rotation of the disc induced by the contact of the drill tip, it being understood that although the wire 12 exerts some restraint on the rotation of the disc it does not make such rotation impossible. Still further, if the drill has been aimed so as to encounter the circumferential region of the disc 11 over which passes the wire 12, if any success is achieved in penetrating the disc then the wire 12 will also be severed or dislodged, allowing the plunger 14 to engage in the notch 16 under the action of the spring 18, thereby effecting an additional locking action on the bolts 2 which must be removed before the door can be opened.

Of course this relocking system may also be useful in the event of attacks other than a drilling attack on the lock 4. For example the plunger will be released to engage with the cross-arm 17 if the wire 12 is severed by the penetration of a drill, chisel, oxyacetylene torch, thermic lance or the like tool at any point along its length, or if the wire is dislodged from the disc 11, e.g. by the use of explosives or other gross force. It is also within the scope of the invention for the fixed anchorage 13 to be replaced by a frangible plate or the like which disintegrates to release the wire and plunger in the event of force being applied. Again, a 'live' relocker can be used instead of the above-described 'dead' system. In this case one end or an intermediate part of the wire 12 is connected to the primary lock bolt 9 so that normally the plunger 14 is engaged and withdrawn whenever the bolt 9 is engaged or withdrawn. However, if the wire is severed during an attack on the safe the connection between the plunger and primary lock is removed so that the plunger will remain engaged even if the attack succeeds in releasing the primary lock.

It will be appreciated that although the invention has been described above in terms of its application to boltwork provided only along one edge of a safe door it can readily be adapted for use in relation to more complex, and secure, boltwork, e.g. where bolts are thrown from three or all four edges of a door by a common operating mechanism. Similarly, there may be more than one primary lock, each provided with an individual anti-drilling disc over each of which a common relocker wire runs, or there may be a separate relocker associated with each disc.

I claim:

1. A security enclosure having a door provided with a locking mechanism comprising: boltwork for securing the door closed when said boltwork is thrown; a primary lock for selectively locking the boltwork in its thrown condition; a drill-resistant member rotatably mounted in a position between the primary lock and the exterior of the door; a secondary locking member capable of locking the boltwork in its thrown condition and being biased towards a locking position; and a flexible tension member following a path controlled by said drill-resistant member and arranged normally to maintain the secondary locking member away from its locking position against such bias, or to withdraw the secondary locking member from its locking position against such bias when the primary lock is released, whereby relieving the tension in the flexible tension member permits the secondary locking member to move into, or remain in, its locking position under such bias.

2. A mechanism according to claim 1 wherein the primary lock is a key-operated lock and the drill-resistant disc is borne by a key guide of the lock.

* * * * *

UNITED STATES PATENT AND TRADEMARK OFFICE

CERTIFICATE OF CORRECTION

PATENT NO. : 4,470,275

DATED : September 11, 1984

INVENTOR(S) : Jeffrey O. Fisher

It is certified that error appears in the above-identified patent and that said Letters Patent is hereby corrected as shown below:

On the title, the following should be added:

--[30] Foreign Application Priority Data

February 8, 1980 [GB] United Kingdom.....04252/80 --.

Signed and Sealed this

*Nineteenth* Day of *February 1985*

[SEAL]

*Attest:*

DONALD J. QUIGG

*Attesting Officer* *Acting Commissioner of Patents and Trademarks*